United States Patent [19]

Domian

[11] Patent Number: 4,807,380

[45] Date of Patent: Feb. 28, 1989

[54] FIREARM

[75] Inventor: Robert E. Domian, Somers, Conn.

[73] Assignee: Dan Wesson Arms, Inc., Monson, Mass.

[21] Appl. No.: 71,751

[22] Filed: Jul. 9, 1987

[51] Int. Cl.[4] ..... F41C 1/00; F41C 11/02

[52] U.S. Cl. ..... 42/65; 42/59; 42/1.07

[58] Field of Search ..... 42/59, 65, 66, 68, 1.07

[56] References Cited

U.S. PATENT DOCUMENTS

| | | | |
|---|---|---|---|
| 50,232 | 10/1865 | Elliot | 42/65 |
| 222,167 | 12/1879 | Wesson | 42/65 |
| 233,363 | 10/1880 | Merritt | 42/59 |
| 338,760 | 3/1886 | Merritt | 42/59 |
| 380,682 | 4/1888 | Holmes | 42/59 |
| 473,903 | 5/1892 | Bovy | 42/65 |
| 1,972,763 | 9/1934 | Dutton | 42/59 |
| 3,176,422 | 4/1965 | Harris | 42/59 |

*Primary Examiner*—Deborah L. Kyle
*Assistant Examiner*—Michael J. Carone
*Attorney, Agent, or Firm*—Wolf, Greenfield & Sacks

[57] ABSTRACT

A locked breech mechanism for a firearm having a trigger, cylinder, and hammer and in which the cylinder is adapted to accommodate cartridges such as a bottleneck cartridge. The breech mechanism includes a breech member disposed between the hammer and cylinder in combination with an operating member. The breech operating member is in the form of a yoke member having a rest position in which the breech member is disengaged from a cartridge in the cylinder, and an active position in which the breech member is engaged with and locked against the cartridge.

35 Claims, 3 Drawing Sheets

FIREARM

BACKGROUND OF THE INVENTION

1. Field of the Invention

The present invention relates in general to firearms. More particularly, the invention pertains to an improved breech construction as in particular applied to revolvers.

2. Background Discussion

In certain instances it is desirable with revolvers to employ bottleneck cartridges. In this connection for typical revolver constructions refer to U.S. Pat. Nos. 4,213,263; 4,218,839; and 4,219,954 all owned by the present assignee herein. However, one of the problems with bottleneck cartridges is that, when the round is fired the cartridge rim expands sufficiently in a rearward direction so that the cartridge essentially binds between the cylinder wall and the frame of the firearm. When this occurs then the firearm cannot be fired in succession. The jammed cartridge has to be removed before the weapon can be fired again.

Accordingly, it is an object of the present invention to provide an improved firearm construction that permits the use of, in particular, bottleneck-type cartridges without causing a jamming of the cartridge in the firearm.

Another object of the present invention is to provide more particularly, an improved breech construction that prevents rearward expansion of the bottleneck-type cartridge, thus permitting a ready and smooth rotation of the cylinder for rapid firing.

A further object of the invention is to provide an improved breech construction for a firearm in accordance with the preceding object and which is relatively simple in construction, requires little maintenance, and can be fabricated relatively inexpensively without adding any substantial costs to the overall firearm.

SUMMARY OF THE INVENTION

To accomplish the foregoing and other objects, features and advantages of the invention there is provided a firearm that is comprised of a frame, a trigger mounted in the frame and a cylinder also mounted in the frame and having a plurality of passages for accommodating cartridges. In accordance with the present invention there is in particular provided an improved breech construction that enables the firearm of the invention to be used with a varity of different types of cartridges including bottleneck-type cartridges. The breech member is supported in the frame disposed between the frame, the firearm hammer and the firearm cylinder. A breech operating means is provided also supported in the frame and disposed operatively between the trigger and breech member. The breech operating means is adapted to have a rest position in which the breech member is disengaged from the cartridge and an active position in which the breech member is engaged with and locked against the cartridge. For this purpose the breech operating means generally comprises a cam that is preferably integral with the trigger along with an elongated cam follower, preferably in the form of a yoke member that is responsive to cam rotation coincident with trigger rotation for causing the cam follower (yoke member) to engage and slide the breech member toward engagement with the cartridge. At a particular point in the motion of the breech member, but prior to firing, the yoke member is positioned to lock the breech member in a fixed position against the rear rim of the cartridge. Upon firing, with the breech member in this position the cartridge is prevented from any rearward expansion. After the firing and when the trigger has been returned to its rest position the breech member returns also to its rest position disengaged from the cartridge. The cylinder, once the breech member moves away from the cartridge, is then in a position to be readily rotated. The mechanism operates so that the breech member is moved away from the cartridge prior to the associated mechanisms rotating the cylinder. In connection with cylinder rotation mechanisms refer to the aforementioned U.S. patents.

With more particularity regarding the disclosed embodiment of the present invention herein, there may also be provided a first spring engageable with the yoke member for urging the yoke member into contact with the cam that is carried by the trigger. In this connection the cam preferably has a low radius segment engaging the cam follower in the rest position and a higher radius segment engaging the cam follower in the active position. For accommodating the yoke member, the frame preferably has a vertically extending groove or the like for receiving the yoke member in sliding relation therein. For moving the breech member it is preferably provided with a ramp against which the top of the yoke member rides. For the purpose of locking there is provide at least one pin fixed in the frame. The top of the yoke member is adapted to be urged between the pin and ramp to move the breech member, and at the end of the move essentially lock the breech member. There may also be provided a second spring acting directly on the breech member to return the breech member to a rest position spaced from the cartridge. The breech member may have opposed recesses defining flats for receiving the yoke member and further including a pair of pins supported from the frame and extending, respectively, into the opposed recesses. The aforementioned spring may be supported at one end in the frame and at the other end in the yoke of the yoke member. A firing pin is supported in the breech member.

In accordance with an alternate embodiment of the invention described herein there may be provided link means supported at the top end of the cam follower (yoke member) and having a locked position when the breech member is moved to its active position and having a partially folded position when the breech member is at its rest position. The link means preferably includes a pair of links commonly connected at one end to the top end of the cam follower. Means are also provided for securing the opposite end of one link to the breech member and the opposite end of the other link to the frame.

In accordance with the present invention there is also provided a method of engaging and locking a breech member against a cartridge that is supported in a cylinder which in turn is supported in a firearm frame. The firearm furthermore includes a trigger means for firing the firearm and a hammer means adapted, upon firing, to impact a firing pin supported by the breech member. This method comprises the steps of providing a breech operating means and supporting the breech operating means in a position responsive to the trigger means for moving the breech member from a rest position in which the breech member is disengaged from the cartridge (corresponding to the rest position of the trigger means), to an active position in which the breech member is engaged with the cartridge (corresponding to an active position of the trigger means). The final step is one of maintaining the breech member locked against the cartridge in preparation of firing when the hammer means impacts the firing pin. Further steps include providing a fixed member secured to the frame and urging the breech operating means between the fixed member and breech member to move and lock the breech member against the cartridge. For this purpose the breech member may be provided with a ramp for engagement by the breech operating means. In an alternate embodiment a link member is provided for engagement by the breech operating means.

BRIEF DESCRIPTION OF THE DRAWINGS

Numerous other objects, features and advantages of the invention should now become apparent upon a reading of the following detailed description taken in conjunction with the accompanying drawings in which.

DETAILED DESCRIPTION

Reference is now made to the drawings for an illustration of the concepts of the present invention as applied to a hand revolver. There are basically two different embodiments of the invention described herein. FIGS. 1–7 describe a first embodiment of the present invention employing a yoke member that is adapted to interengage with a ramp on the breech member. The second embodiment of the invention is illustrated in the FIGS. 8–10 employing a link means coupled between a yoke member and the breech member.

Figure 1:
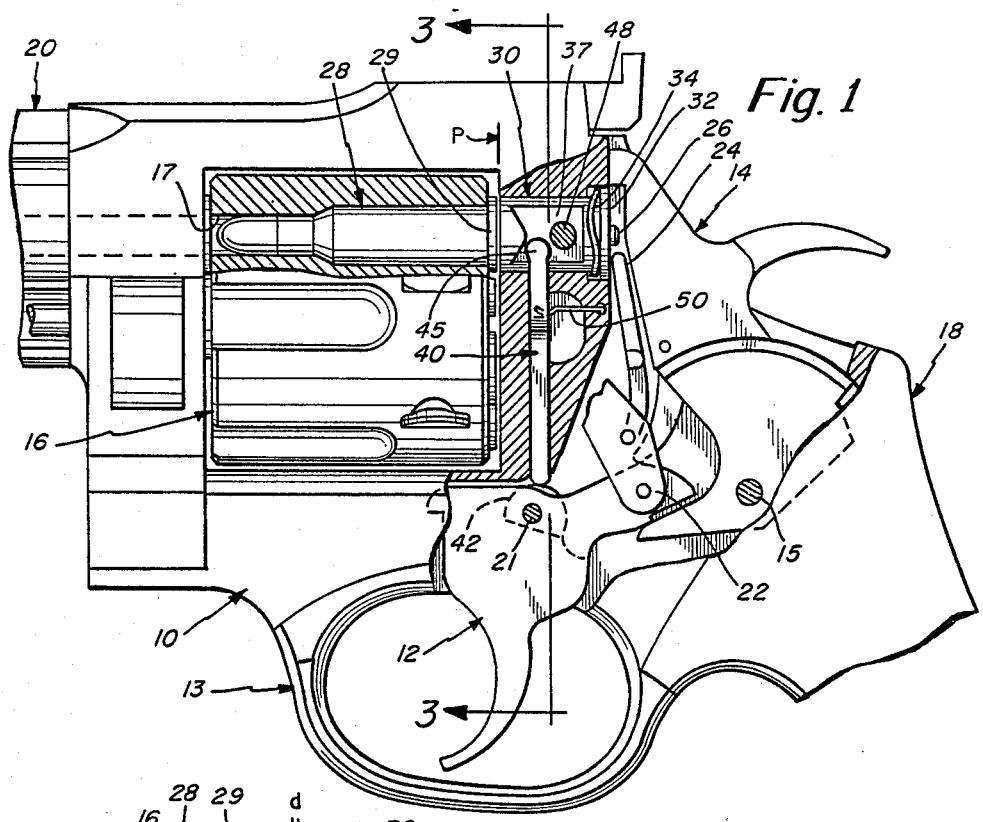
FIG. 1 is a fragmentary side elevation view partially cut away and illustrating the breech construction associated with a firearm as in accordance with the invention.
Figure 2:
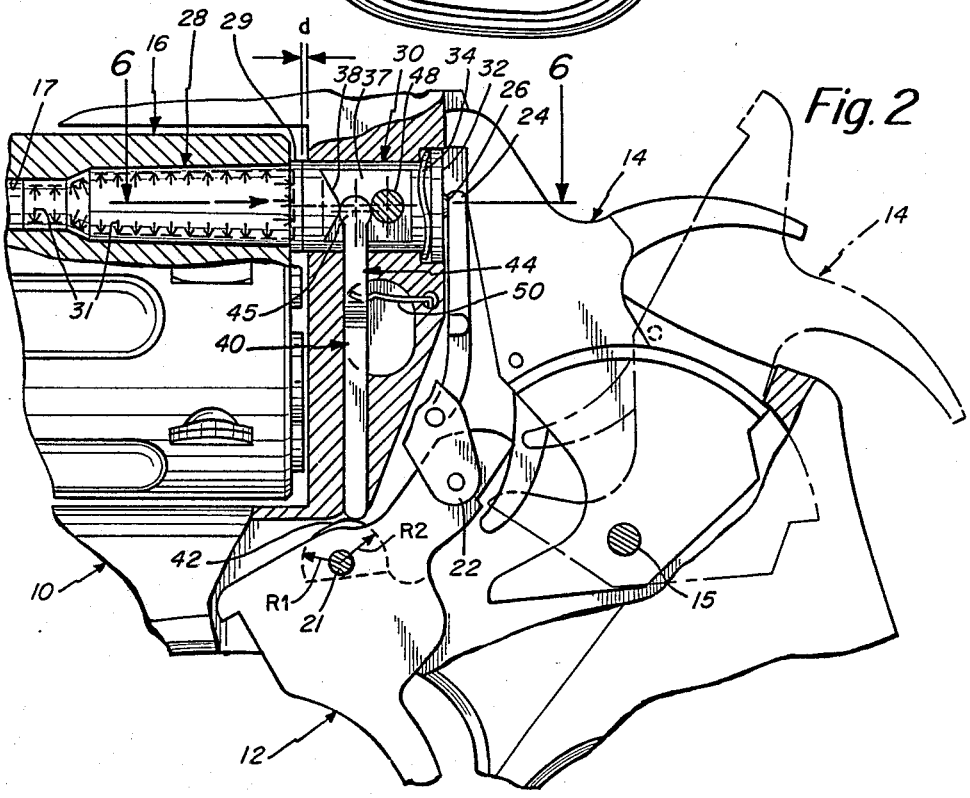
FIG. 2 is also a fragmentary part cross-sectional view illustrating the position of the breech member just upon firing of the firearm.

Referring now to the first embodiment in the FIGS. 1–7 there is illustrated a firearm that includes a frame 10 that is partially cut away to illustrate additional parts of the firearm and include the trigger 12, hammer 14, and a cylinder 16. Associated with the trigger 12 is a trigger guard 13. FIG. 1 also illustrates a part of the firearm handle 18 and barrel 20. FIGS. 1 and 2 also illustrate the hammer 14 with its associated pivot pin 15.

Associated with the trigger 12 is a trigger pivot 21. The trigger 12 also has supported therefrom, the hand 22 which in turn has supported therefrom the transfer bar 24. For further details regarding the operation of the hand 22 and the transfer bar 24 refer to U.S. Pat. No. 4,218,839. The hand 22 is employed to advance the cylinder from one bullet to the next. The transfer bar 24 is selectively moved into a position for providing contact with the firing pin 26. In this regard, in the position of FIG. 1, the firearm is at what might be considered a rest position with the trigger in its normal unused position. In this position it is noted that the transfer bar 24 is out of contact with the firing pin 26. On the other hand, in the embodiment of FIG. 2 as illustrated in solid outline, the weapon has just been fired. It is noted that the trigger 12 is pulled to its rear position thus moving the transfer bar 24 up behind the firing pin 26. When the hammer 14 is released then the hammer strikes the transfer bar 24 which in turn strikes the firing pin 24 causing a firing of the weapon.

The cylinder 16 is supported in the frame for selective rotation from the hand 22. The cylinder 16 includes a plurality of passages 17 for accommodating bullets. Refer in particular to FIG. 1 which illustrates a bottleneck cartridge 28 having a rear rim 29. FIG. 2 illustrates cartridge 28 after the round has been fired. In FIG. 1 it is noted that the rim 29 is displaced slightly from the rear cylinder cavity wall. Note in FIG. 1 the plane P and that the cartridge rear rim 29 is spaced by a slight gap from this plane. Also note in FIG. 1 that the breech member 30 has its forward face in line with the plane P in the rest position of the weapon. It is furthermore noted that, in accordance with the invention the breech member 30, as illustrated in FIG. 2, is moved by a distance d as illustrated in FIG. 2 to engage the rim 29 of the bottleneck cartridge 28 in a firing position of the weapon.

FIG. 2 also illustrates by a series of arrows the forces that are applied on the bottleneck cartridge at the time of firearm firing. The summation of these forces has a rearward component that is directed in the direction of the rim 29. Without the provision of the slideable and engaging breech member, these forces would cause a rearward expansion of the rim 29 causing the jamming problem previously referenced in connection with the background discussion herein.

Figure 3:
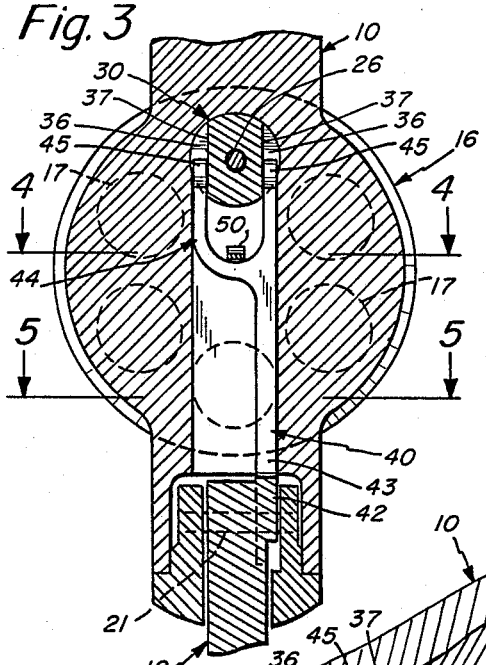
FIG. 3 is a cross-sectional view taken along line 3—3 of FIG. 1.
Figure 6:
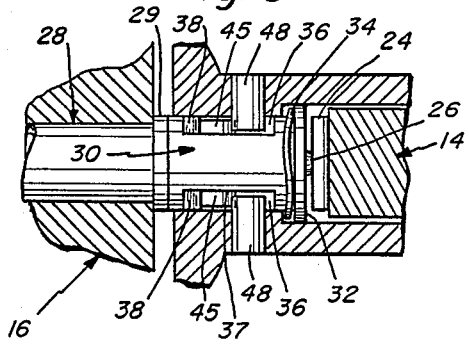
FIG. 6 is a cross-sectional view taken along line 6—6 of FIG. 2.
Figure 7:
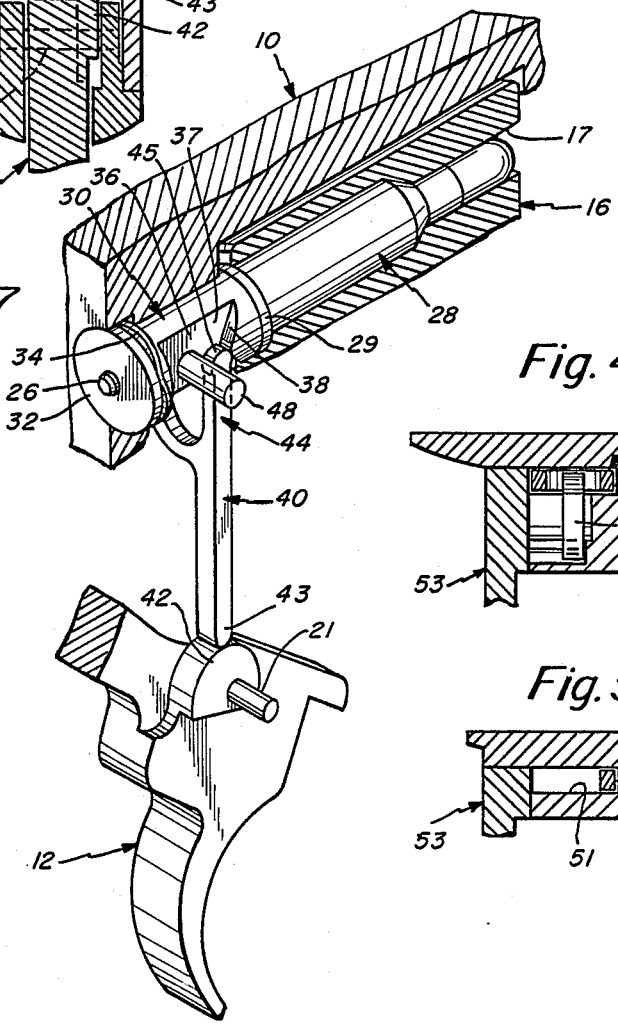
FIG. 7 is a cut away perspective view illustrating the operation of the locked breech construction of the present invention.

Reference has been made hereinbefore to the breech member 30. The details of member 30 are found in FIGS. 2, 3, 6 and 7. The breech member 30 supports the firing pin 26 as illustrated in FIGS. 3 and 7. The firing pin 26 is supported at the head 32 of the breech member 30. Disposed intermediate the head 32 and the frame of the firearm is the wavewasher 34 that is adapted to bias the breech member 30 to a rearward position such as illustrated in FIG. 1. In this position, as noted previously, the front face of the breech member 30 lies along the plane P.

The breech member 30 also has side disposed recesses 36 defining opposed flat surfaces 37. Associated with these respective flat surfaces 37 are ramps 38. There is a ramp on either side of the breech member 30, such as is illustrated in FIGS. 3 and 6. The ramps 38 are instrumental in moving the breech member 30 such as from the position of FIG. 1 to the position of FIG. 2. To cause this movement there is provided a yoke member 40 that is operated from cam 42 and extends from the cam 42 to the breech member 30. For details of the yoke member 40 refer to FIGS. 3 and 7. The yoke member 40 has a bottom end 43 that engages the cam 42 and furthermore has a yoked top end 44 carrying oppositely disposed nodes. It is noted that these nodes 45 are positioned in the recesses 36 against the flat surfaces 37 such as is illustrated in FIG. 3. There is thus a relatively close tolerance fit between the yoke 40 and breech member 30. Also associated with the breech member 30 are a pair of pins 48 each supported, as illustrated in FIG. 6, from the frame of the firearm and each adapted to extend into the oppositely disposed recesses 36.

The yoke member 40 is in essence a cam follower and is biased against the cam 42 by means of the spring 50. As illustrated, for example, in FIG. 2, one end of the spring 50 is supported in the frame 10. Also refer to the cross-sectional view of FIG. 4. The other end of the spring 50 sits in the yoke end 44 of member 40. The spring 50 biases the yoke member 40 to a downward position forcing the yoke member 40 against the cam 42.

Referring to FIG. 2, it is noted that the cam 42 pivots about 21 (also refer to FIG. 7) and the cam 42 has at least two different radii. There is a smaller radius R1 and a larger radius R2 as depicted in FIG. 2. In FIG. 1 the yoke member 40 is on the smaller radius R1 and thus the yoke member 40 is in its lowermost position. It is noted in FIG. 1 in that position the yoke member 40 is at an intermediate position along the ramp of the breech member 30 and has not yet contacted the pins 48. FIG. 2 illustrates the trigger having been pulled to a point where the cam 42 is now on its larger radius R2. The transition from radius R1 to R2 causes a lifting of the yoke member 40 so that it is thus moved to the position illustrated in FIG. 2. The yoke member 40 has moved up on the ramp to very close to the apex of the ramp and the nodes 45 of the yoke member 40 are firmly positioned between the ramp 38 and the pins 48. In the position illustrated in FIG. 2, the hammer 14 is shown in phantom in a position in which the weapon is just about to be fired. In that position the yoke member 40 is essentially in a locked position with the nodes 45 between the ramp 38 and the fixed pins 48. In the solid position in FIG. 2, the hammer 14 is shown having just been fired with the trigger 12 still squeezed.

When the trigger 12 is released it moves back to the position illustrated in FIG. 1. The spring 50 causes the yoke member 40 to move downwardly as soon as the trigger moves to a position in which the yoke member 40 contacts a smaller radius segment of the cam 42. The yoke member 40 moves downwardly to the position shown in FIG. 1.

It is noted that in the position of FIG. 2, the upward movement of the yoke member 40 has caused, by engagement with the ramp 38, the breech member 30 to move so that its front face contacts the rim 29 of the cartridge. In this way when the weapon is fired, the forward face of the breech member prevents the rim 29 of the bottleneck cartridge from expanding to any great extent toward the rear. After the firing and when the trigger 12 is released, the yoke member 40 moves downwardly, as previously indicated and when the trigger 12 is fully released the breech member 30 is thus returned to the position illustrated in FIG. 1. There thus remains a gap illustrated by the dimension d in FIG. 2 between the breech member 30 and the rear of the cartridge. When the breech member 30 moves rearwardly there is thus provided the aforementioned gap and by virtue of this gap the cylinder is then in a position where it can be easily rotated. Cylinder rotation is preferably automatic and is responsive to trigger action as controlled by the hand 22.

Figure 4:
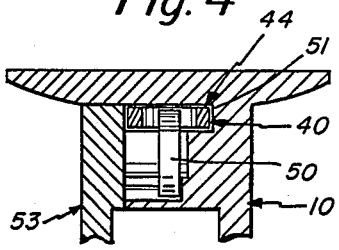
FIG. 4 is a cross-sectional view taken along line 4—4 of FIG. 3 in an embodiment employing a side plate.
Figure 5:
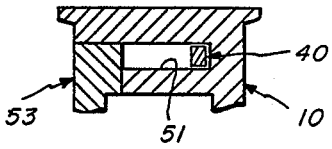
FIG. 5 is a cross-sectional view taken along line 5—5 of FIG. 3 again in an embodiment employing a side plate.

The yoke member 40 preferably moves within a groove in the frame 10. This is illustrated, for example, in FIG. 4 by the groove 51 for accommodating the yoke member 40. In the embodiment of the invention illustrated in FIG. 3, it is noted that the frame is substantially solid. However, in an alternate embodiment such as is illustrated in FIGS. 4 and 5, there may be provided a side plate 53 for providing access to the spring 50 and the yoke member 40.

Figure 8:
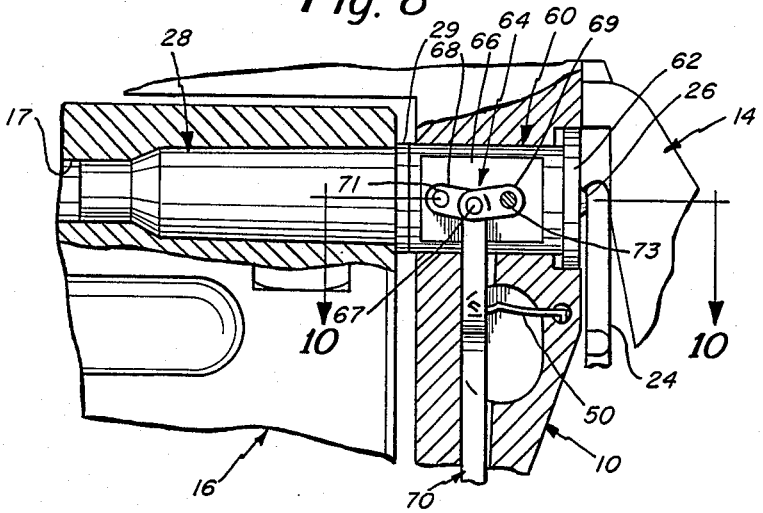
FIG. 8 is a fragmentary cross-sectional view of an alternate embodiment of the invention employing a link means.
Figure 9:
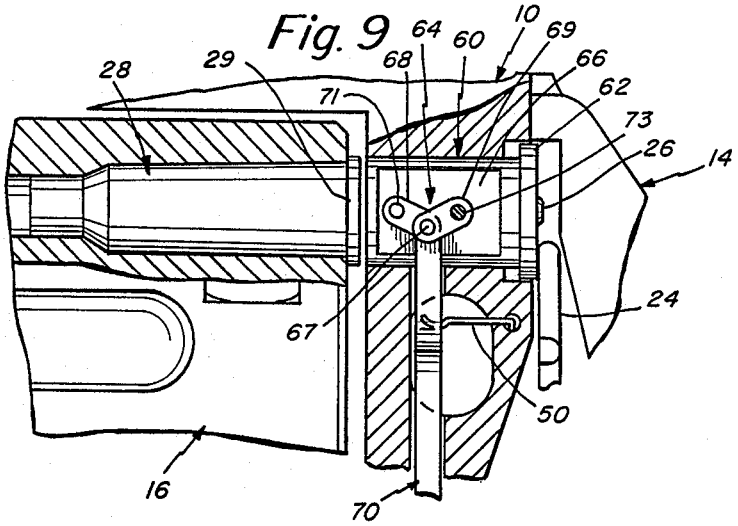
FIG. 9 is a cross-sectional view similar to that of FIG. 8 but illustrating the yoke member in its rest position.
Figure 10:
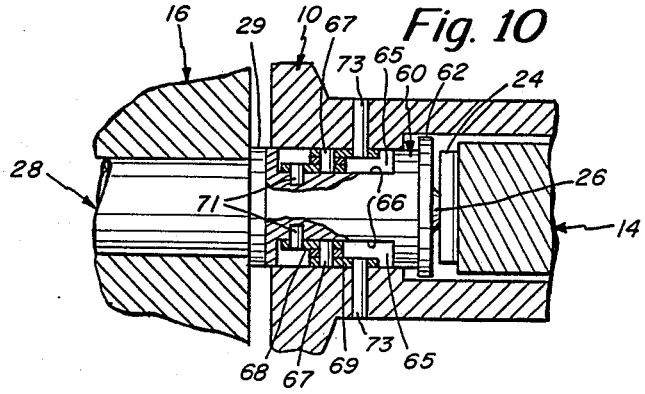
FIG. 10 is a cross-sectional view taken along line 10—10 of FIG. 8.

Reference is now made to an alternate embodiment of the invention illustrated in FIGS. 8–10. In this embodiment of the invention, the same reference characters are used to identify similar parts previously referenced in the first embodiment. Furthermore, in the embodiment of the invention illustrated in FIGS. 8–10, the primary change relates to the specific means by which the breech member is operated. In this regard, in this embodiment there is illustrated a breech member 60 having a front face that is adapted to engage the cartridge rim 29 in the same manner as in the first embodiment. The breech member 60 also includes a rear flange 62 that is adapted to be received in an accommodating recess in the frame. The breech member 60 carries a firing pin 26.

In the fragmentary cross-sectional embodiment of FIG. 8 the firearm is shown in a position in which the weapon has just been fired in which case the breech member 60 has been moved to its forward position with its front face engaging the cartridge rim 29 to prevent the rearward expansion of the cartridge rim. In the fragmentary cross-sectional view of FIG. 9 the breech member 60 is shown in its rest position with the breech member 60 spaced from the cartridge rim 29. The cross-sectional view of FIG. 10 is taken along line 10—10 of FIG. 8 and thus also illustrates the breech member 60 with its front face in contact with the rim 29 of the bottleneck cartridge.

The means by which the breech member 60 is moved in this second embodiment comprises a link mechanism 64 that is secured to the yoke member 70. The yoke member 70 may be of the general construction illustrated in the first embodiment having a yoked top end. The breech member 60 has opposed recesses 65 that define flat surfaces 66 that are adapted to receive the top sides of the yoked top end of the member 70.

A first pair of pins 67 secure the yoke member 70 to the link mechanism 64. The link mechanism 64 comprises oppositely disposed pairs of links 68 and 69. The links 68 are secured to the breech member 60 by means of pins 71. Similarly, the links 69 are secured to fixed pins 73. The pins 73, as illustrated in the cross-sectional view of FIG. 10, are secured in the frame of the firearm.

In the rest position of the trigger, the yoke member 70 is also in a rest position which is a lower position as is illustrated in FIG. 9. The spring 50 biases the yoke member 70 to this downward position. In this position it is noted that the link mechanism 64 is essentially folded. Because the pins 73 are fixed in the frame, when the yoke member 70 is moved downwardly, this causes the links 68 and 69 to be out of linear alignment thus causing the breech member 60 to move rearwardly to the position illustrated in FIG. 9.

Now, when the weapon is being fired and the trigger is pulled, the cam action previously illustrated in, for example, FIG. 2, causes the yoke member 70 to move upwardly against the bias of spring 50. At the position illustrated in FIG. 8, the yoke member 70 has moved up to a position wherein links 68 and 69 are just about in linear alignment. Because the pins 73 are fixed in position, when the yoke member 70 moves upwardly, this causes the breech member 60 to move to the left as viewed in FIG. 8 causing breech member 60 front face to engage against the rim 29 of the bottleneck cartridge, as is illustrated in FIG. 8. In this position, upon the firing of the weapon, the breech member 60 prevents rearward expansion of the rim 29. When the trigger is then released, the breech member 60 immediately moves out of engagement with the cartridge, as soon as the yoke member 70 moves downward even slightly. When the cylinder rotates thus, the rotation can occur without any binding between the cylinder and any parts of the frame.

In connection with the two embodiments of the invention described herein, weapons have been fired employing this locked breech principle and the forces that have been imposed by the firing of the cartridge have been more than adequately balanced by the mechanisms employed. The ramp and pin arrangement in the first embodiment provides a strong locking mechanism that will more than adequately withstand the forces imposed by the firing of the weapon. Similarly, the link mechanism illustrated in the second embodiment also more than adequately withstands the forces imposed at the rear of the cartridge upon firing. In the first embodiment the forces are counteracted by the interlocking provided between the ramp and the fixed pin. In the second embodiment the forces are counteracted by the substantially linear arrangement of the links that are provided by the link mechanism.

Having now described a limited number of embodiments of the present invention, it should now be apparent to those skilled in the art that numerous other embodiments and modifications thereof are contemplated as failing within the scope of the present invention as defined by the appended claims.

What is claimed is:

1. A firearm comprising;

a frame, a trigger, means mounting the trigger in the frame, a cylinder mounted in the frame and having a plurality of cartridge-accommodating passages, a hammer also mounted in the frame and responsive to trigger action, a breech member, means supporting the breech member in the frame disposed between the hammer and cylinder, breech operating means, and means supporting the breech operating means in the frame disposed operatively between the trigger and breech member, said breech operating means having a rest position in which said breech member is disengaged from a cartridge in said cylinder, and an active position in which said breech member is engaged with and locked against the cartridge, said breech operating means comprising a cam integral with said trigger and an elongated cam follower responsive to cam rotation coincident with trigger rotation for causing said cam follower to engage and slide said breech member toward engagement with the cartridge.

2. A firearm as set forth in claim 1 including a first spring engageable with said cam follower for urging the cam follower into contact with the cam carried by the trigger.

3. A firearm as set forth in claim 2 wherein said cam has a low radius engaging the cam follower in the rest position and a high radius engaging the cam follower in the active position.

4. A firearm as set forth in claim 3 wherein said cam follower comprises a yoke member, said frame having a vertically extending groove for receiving said yoke member in sliding relation therein.

5. A firearm as set forth in claim 4 wherein said breech member has means defining a ramp against which the top of the yoke member rides.

6. A firearm as set forth in claim 5 including at least one pin fixed in the frame, the top of the yoke member adapted to be urged between said pin and ram to move said breech member.

7. A firearm as set forth in claim 6 including a second spring acting directly on the breech member to return the breech member to a rest position spaced from the cartridge.

8. A firearm as set forth in claim 7 wherein said breech member has opposed flats for receiving said yoke member and further including a pair of pins supported from the frame and extending respectively into the opposed flats.

9. A firearm as set forth in claim 8 wherein said first spring is supported at one end in the frame and at the other end in the yoke of the yoke member.

10. A firearm as set forth in claim 9 including a firing pin supported in said breech member.

11. A firearm as set forth in claim 1 including pin means fixed in the frame, said cam follower having a top end that engages between said pin means and a surface of said breech member for moving said breech member relative to said pin means.

12. A firearm as set forth in claim 11 wherein said breech member has a ramped surface against which the top end of the cam follower engages.

13. A firearm as set forth in claim 1 wherein said cam follower comprises an elongated member having a bottom end engaging the cam and a top end adapted to moved said breech member.

14. A firearm as set forth in claim 13 including a link means supported at the top end of the cam follower and having a locked position when the breech member is moved to its active position and having a partially folded position when the breech member is at its rest position.

15. A firearm as set forth in claim 15 wherein the link means includes a pair of links commonly connected at one end to the top end of the cam follower.

16. A firearm as set forth in claim 15 including means securing the opposite end of one link to the breech member and the opposite end of the other link to the frame.

17. A firearm as set forth in claim 16 wherein said cam follower comprises a yoke member.

18. A firearm as set forth in claim 17 wherein said breech member has opposed recesses forming opposed flats for receiving said yoke member.

19. A method of engaging and locking a breech member against a cartridge that is supported in a cylinder which in turn is supported in a firearm frame, said firearm furthermore including trigger means for firing said firearm and a hammer means adapted, upon firing, to impact a firing pin, said method comprising the steps of, supporting said firing pin by means of the breech member, providing a breech operating means, supporting said breech operating means in a position responsive to said trigger means for moving said breech member from a rest position in which said breech member is disengaged from the cartridge and corresponding to a rest position of the trigger means, to an active position in which said breech member is engaged with said cartridge and corresponding to an active position of the trigger means, maintaining the breech member locked against said cartridge in preparation for firing when the hammer means impacts the firing pin, providing a fixed member secured to the frame and urging the breech operating means between the fixed member and breech member to move and lock the breech member against the cartridge, and providing a ramp on the breech member for engagement by the breech operating means.

20. The method as set forth in claim 19 including providing a cam operable from said trigger for urging the breech operating means into operative engagement on said ramp.

21. In a firearm having a frame, a cylinder for accommodating cartridges, a trigger and hammer, the improvement comprising, a breech member, means supporting the breech member in the frame disposed between the hammer and cylinder, breech operating means, and means supporting the breech operating means in the frame disposed operatively between the trigger and breech member, said breech operating means having a rest position in which said breech member is disengaged from a cartridge in said cylinder and an active position in which said breech member is engaged with and locked against the cartridge, said breech operating means comprising a cam integral with said trigger and an elongated cam follower responsive to cam rotation coincident with trigger rotation for causing said cam follower to engage and slide said breech member toward engagement with the cartridge.

22. A firearm as set forth in claim 21 wherein said cam follower comprises a yoke member, said frame having a vertically extending groove for receiving said yoke member in sliding relation therein.

23. A firearm as set forth in claim 22 including a first spring in engagement with said cam follower for urging the cam follower into contact with the cam, said cam having a low radius engaging the cam follower in the rest position and a high radius engaging the cam follower in the active position, said breech member having means defining a ramp against which the top of the yoke member rides, and a second spring acting directly on the breech member to return the breech member to a rest position spaced from the cartridge.

24. In a firearm having a frame, a cylinder for accommodating cartridges, a trigger and a hammer, the improvement comprising, a breech member, means supporting the breech member in the frame disposed between the hammer and cylinder, breech operating means, means supporting the breech operating means in the frame disposed operatively between the trigger and breech member, said breech operating means having a rest position in which said breech member is disengaged from a cartridge in said cylinder and an active position in which said breech member is engaged with and locked against the cartridge, a cam operable from said trigger, said breech operating means comprising a cam follower responsive to cam rotation for causing said cam follower to engage and move said breech member from its rest position to its active position.

25. A firearm as set forth in claim 24 including a ramp provided on the breech member for engagement by the cam follower.

26. A firearm as set forth in claim 25 wherein said cam follower comprises a yoke member and said breech member has opposed recesses for receiving said yoke member.

27. A firearm as set forth in claim 26 including a first spring and engagement with said cam follower for urging the cam follower into contact with the cam, said cam having a low radius engaging the cam follower in the rest position and a high radius engaging the cam follower in the active position, and a second spring acting on the breech member to return the breech member to a rest position spaced from the cartridge.

28. A firearm as set forth in claim 24 further including a pair of links commonly connected to the cam follower and having opposed ends respectively connected to the frame and breech member, said links being in a substantially linearly aligned position when the operating member is the active position.

29. A firearm as set forth in claim 28 wherein the pair of links are moved to a folded position in the rest position of the breech operating means.

30. In a firearm having a frame, a cylinder for accommodating cartridges, a trigger and hammer, the improvement comprising, a breech member, means supporting the breech member in the frame disposed between the hammer and cylinder, breech operating means, means supporting the breech operating means in the frame disposed operatively between the trigger and breech member, said breech operating means having a rest position in which said breech member is disengaged from a cartridge in said cylinder and an active position in which said breech member is engaged with and locked against the cartridge, said breech operating means including an operating member responsive to trigger action, and a pair of links commonly connected to the operating member and having opposed ends respectively connected to the frame and breech member, said links being in a substantially linearly aligned position when the operating member is in the active position of the breech operating means so as to lock the breech member against the cartridge.

31. A firearm as set forth in claim 30 including a cam operable from said trigger and wherein said operating member comprises a cam follower responsive to cam rotation for causing said cam follower to operate said breech member.

32. A firearm as set forth in claim 31 wherein said operating member comprises a yoke member.

33. A firearm as set forth in claim 32 wherein said breech member has opposed surfaces each carrying a pair of links supported on either side from said yoke member.

34. A firearm as set forth in claim 33 including a first spring in engagement with said yoke member for urging the yoke member into contact with the cam, said cam having a low radius engaging the cam follower in the rest position and a high radius engaging the cam follower in the active position, and a second spring acting on the breech member to return the breech member to a rest position spaced from the cartridge.

35. A firearm as set forth in claim 30 wherein said pair of links is moved to a folded position out of linear alignment when the operating member is in the rest position.

* * * * *